US005253016A

United States Patent [19]

Behe et al.

[11] Patent Number: 5,253,016

[45] Date of Patent: Oct. 12, 1993

[54] CONTAMINANT CONTROL FOR SCAVENGELESS DEVELOPMENT IN A XEROGRAPHIC APPARATUS

[75] Inventors: Thomas J. Behe, Webster; Daniel M. Bray; Jeffrey J. Folkins, both of Rochester; Gerald M. Kryk, Webster; Joseph G. Schram, Liverpool; Cyril Edmunds, Webster, all of N.Y.

[73] Assignee: Xerox Corporation, Stamford, Conn.

[21] Appl. No.: 884,975

[22] Filed: May 18, 1992

[51] Int. Cl.[5] ..... G03G 21/00

[52] U.S. Cl. ..... 355/215; 118/647; 118/651; 355/259; 355/261; 355/298

[58] Field of Search ..... 355/245, 298, 246, 200, 355/215, 261, 259; 118/656, 647, 651, 652, 638; 366/139, 325

[56] References Cited

U.S. PATENT DOCUMENTS

| | | | |
|---|---|---|---|
| 4,100,611 | 7/1978 | Jugle | 366/139 |
| 4,394,086 | 7/1983 | Hoffman, Jr. et al. | 355/200 |
| 4,868,600 | 9/1989 | Hays et al. | 355/259 |
| 4,878,090 | 10/1989 | Lunde | 355/256 |
| 4,984,019 | 2/1991 | Folkins | 355/215 |
| 5,010,367 | 4/1991 | Hays | 355/247 |
| 5,028,959 | 7/1991 | Gooray | 355/215 |

*Primary Examiner*—A. T. Grimley
*Assistant Examiner*—Shuk Y. Lee
*Attorney, Agent, or Firm*—R. Hutter

[57] ABSTRACT

In a development system for conveying toner to a latent image on a surface in an electrophotographic printing apparatus, including a donor structure spaced from the charge retentive surface for conveying toner to a development zone adjacent the surface and an electrode structure disposed between the donor structure and the surface, contaminants are removed from the development zone by a flow of air away from the development zone.

26 Claims, 3 Drawing Sheets

CONTAMINANT CONTROL FOR SCAVENGELESS DEVELOPMENT IN A XEROGRAPHIC APPARATUS

FIELD OF THE INVENTION

The present invention relates to developer apparatus for xerography. More specifically, the invention relates to a device for separating contaminants from toner as part of a scavengeless development process.

BACKGROUND OF THE INVENTION

In the well-known process of electrophotographic printing, such as in xerography or ionography, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be pulled off the developer roll and onto the photoreceptor.

An important variation to the general principle of development is the concept of "scavengeless" development. The purpose and function of scavengeless development are described fully in, for example, U.S. Pat. No. 4,868,600 to Hays et al., U.S. Pat. No. 4,984,019 to Folkins, or U.S. Pat. No. 5,010,367 to Hays. In a scavengeless development system, toner is conveyed to the photoreceptor by means of AC electric fields supplied by self-spaced electrode structures, commonly in the form of wires extending across the photoreceptor, positioned within the nip between a donor roll and photoreceptor. Because there is no physical contact between the development apparatus and the photoreceptor, scavengeless development is useful for devices in which different types of toner are supplied onto the same photoreceptor, as in "tri-level" or "recharge, expose, and develop" highlight or image-on-image color xerography.

A typical scavengeless development apparatus includes, within a developer housing, a magnetic roll, a donor roll, and an electrode structure. The magnetic roll operates in a manner similar to a developer roll, but instead of conveying toner directly to the photoreceptor, conveys toner to a donor roll disposed between the magnetic roll and the photoreceptor. The magnetic roll is electrically biased relative to the donor roll, so that the toner particles are attracted from the magnetic roll to the donor roll. The donor roll further conveys toner particles from the magnetic roll toward the photoreceptor. In the nip between the donor roll and the photoreceptor are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud, forming a toner powder image thereon.

No matter what specific type of development is used, a primary factor affecting copy quality is the purity of the toner. There are two common sources of toner defects which are likely to cause copy quality problems, particularly in scavengeless systems: agglomeration and contamination. Agglomeration is the "clumping" of loose toner particles in the developer housing, and is often the result of high temperatures or mechanical abrasion. Large clumps of agglomerated toner may adhere to the magnetic brush or developer roll and cause streaking against the photoreceptor, which may become apparent as a copy quality defect for numerous copies or prints. Another key source of defects is external contamination of the toner by foreign objects. Common sources of toner contamination include solid shavings created in the manufacture of the apparatus, or small slivers of plastic from the packaging of the toner, as from the rough rim of a plastic toner bottle. Another source of contamination is lint or fibers which circulate through the machine as a result of internal air flow. In the case of scavengeless development, such foreign particles are likely to become ensnared in, or damage, the electrode wires in the nip between the donor roll and the photoreceptor, causing scratching of the photoreceptor, or the developed latent image thereon. Thus, to ensure copy quality, the toner must be free of both agglomerated clumps and foreign material, particularly in the case of scavengeless development.

U.S. Pat. No. 4,100,611 to Jugle discloses a developer apparatus for xerography, wherein a negative pressure is created in the developer housing to prevent migration of particles out of the housing. Defined inside the developer housing is a filter surface comprising a filter of predetermined pore size. A source of suction is provided on the opposite side of the filter surface.

U.S. Pat. No. 4,394,086 to Hoffman, Jr., et al. discloses a dirt barrier for use at the interface between the surface of a moving photoreceptor belt and the open section of a developer housing. The barrier is contoured to follow the surface of the photoreceptor belt and is spaced to minimize air flow between the barrier and the belt.

U.S. Pat. No. 4,878,090 to Lunde discloses an apparatus for developing a latent image with a liquid toner, that is a developer material in which toner particles are suspended in a liquid solution. The developer apparatus includes a housing, or shroud, to contain the liquid developer. The vacuum pump associated with the housing causes a current of air to circulate around the area of contact with the photoreceptor, in order to strip excess liquid developer from the photoreceptor.

U.S. patent application Ser. No. 07/758,993, assigned to the assignee of the present application, describes a development apparatus having an active airflow system for creating airflow out of a developer housing, drawing airborne contaminants therefrom. A developer system includes a plurality of developer housings movable into operative and inoperative positions, as needed. As each developer housing is moved into and out of its operative position, an air duct is rotated therewith for interfacing with or sealing off airflow through the housing, as appropriate.

SUMMARY OF THE INVENTION

According to one aspect of the present invention, a development apparatus conveys toner to a latent image recorded on a surface. A donor structure, spaced from the surface, conveys toner to a development zone adjacent the surface. An electrode structure is disposed in a development zone between the donor structure and the surface. A flow of air is created from the charge retentive surface generally away from the development zone around at least a portion of the donor structure.

According to another aspect of the present invention, a development apparatus for conveying toner to a latent image recorded on a surface comprises a donor structure spaced from the surface, for conveying toner to a development zone adjacent the surface. A magnetic brush roll is provided for conveying toner from a supply to the donor structure, the magnetic brush roll forming a magnetic brush in the form of chains of carrier beads for the carrying of toner thereon. A flow of air is created from the charge retentive surface generally away from the development zone around at least a portion of the donor structure.

BRIEF DESCRIPTION OF THE DRAWINGS

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 3:
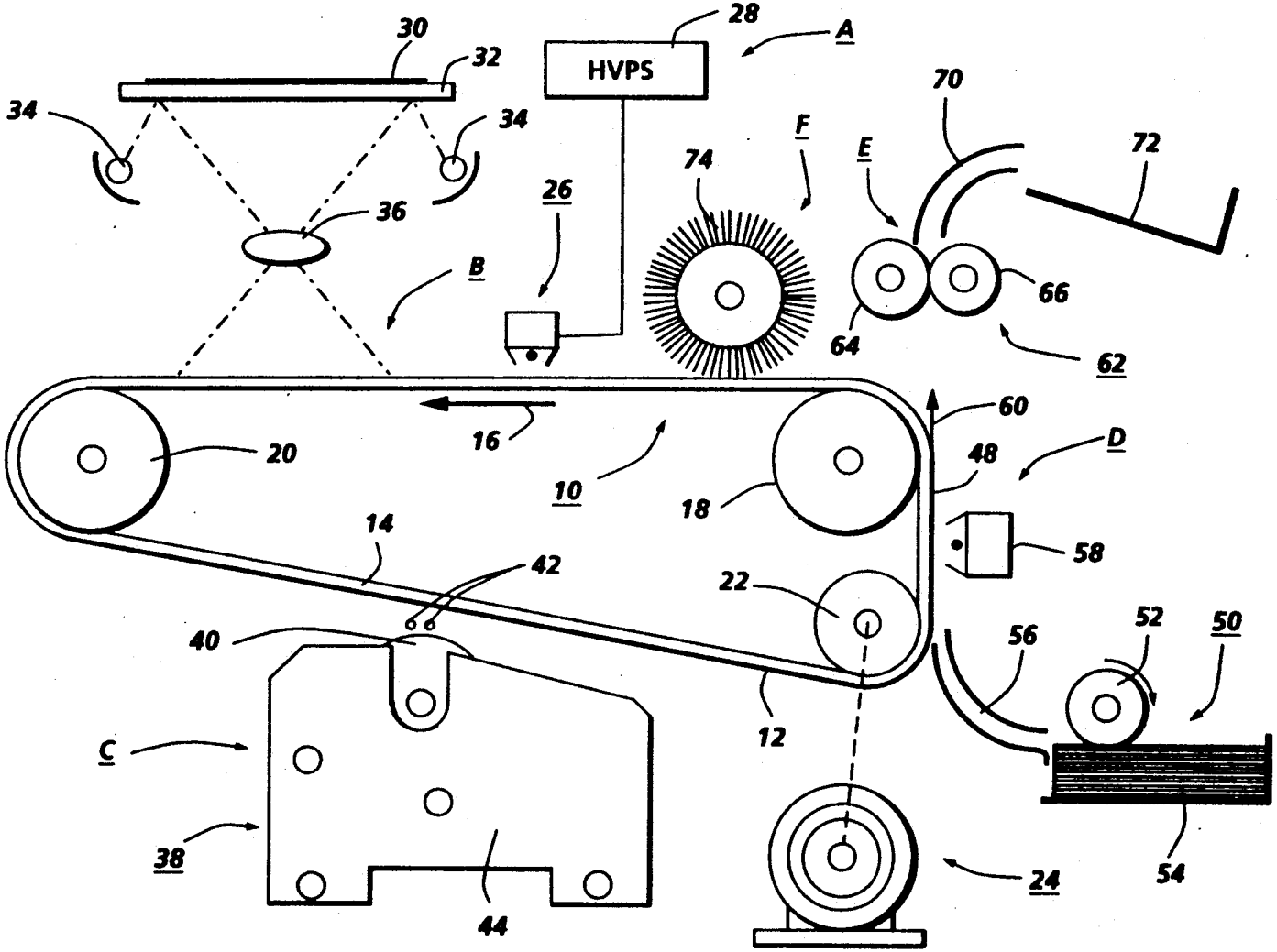
FIG. 3 is an elevational view of an electrophotographic printing apparatus.

Referring initially to FIG. 3, there is shown an illustrative electrophotographic printing machine incorporating the development apparatus of the present invention therein. The electrophotographic printing machine employs a photoreceptor belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a development system, indicated generally by the reference numeral 38, develops the latent image recorded on the photoconductive surface. Preferably, development system 38 includes donor roll 40 and electrode wires 42. During development of the latent image, electrode wires 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. When the development system is non-operative, donor roll 40 does not develop the latent image recorded on photoconductive surface 12 and electrode wires 42 may be cleaned to remove contaminants adhering thereto. Donor roll 40 is mounted, at least partially, in the chamber of developer housing 44. The chamber in developer housing 44 stores a supply of developer material. The developer material is a two component developer material of at least carrier granules having toner particles adhering triboelectrically thereto. A magnetic roller disposed interiorly of the chamber of housing 44 conveys the developer material to the donor roll. The magnetic roller is electrically biased relative to the donor roller so that the toner particles are attracted from the magnetic roll to the donor roller. One embodiment of the development apparatus will be discussed hereinafter, in greater detail, with reference to FIG. 1, and another embodiment in reference to FIG. 2.

With continued reference to FIG. 3, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the present invention in the development apparatus thereof.

Figure 1:
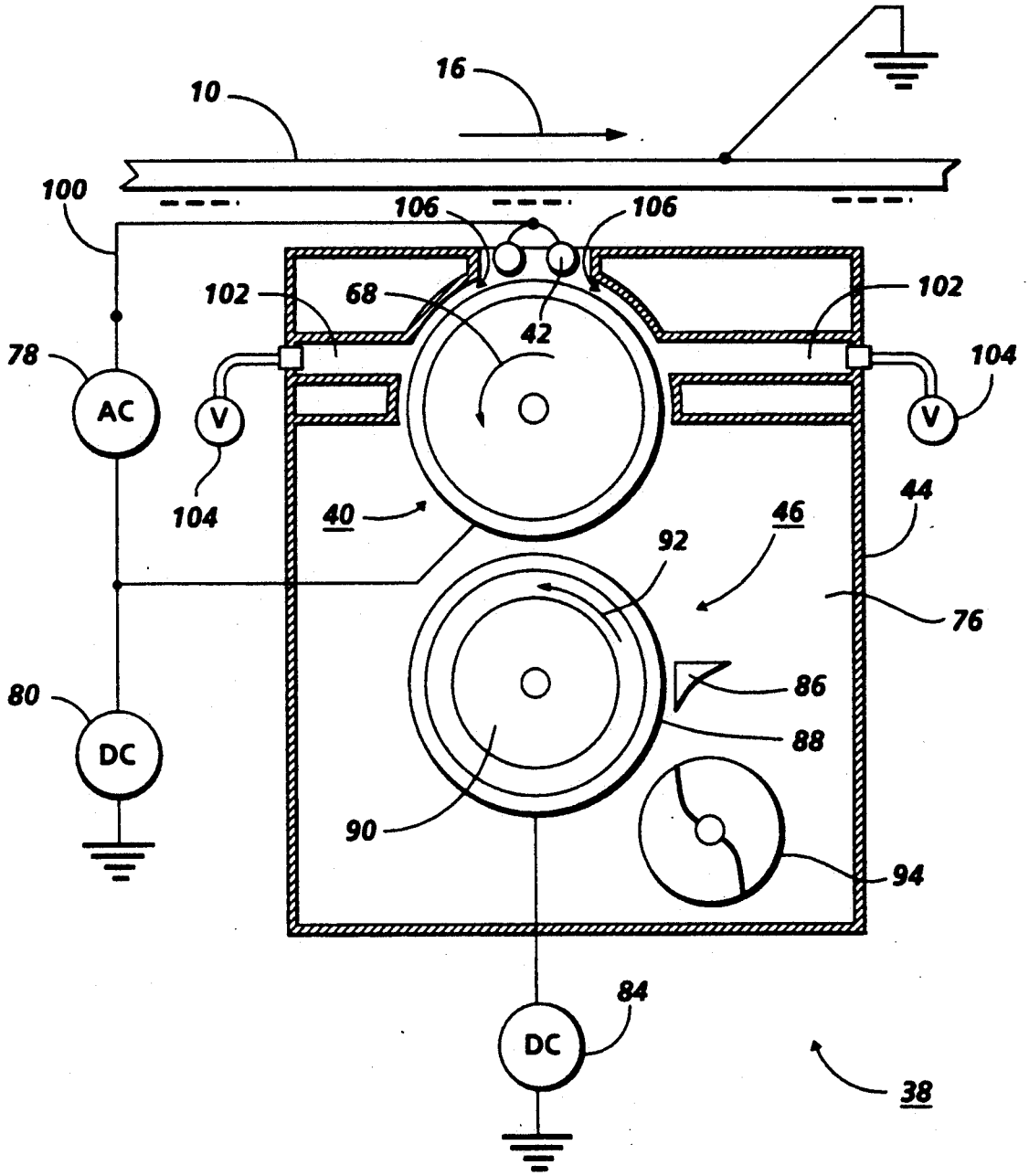
FIG. 1 is a sectional elevational view of a developer station incorporating one embodiment of the present invention.

Referring now to FIG. 1, there is shown development system 38 in greater detail. Development system 38 includes a housing 44 defining a chamber 76 for storing a supply of developer material therein. Donor roll 40, electrode wires 42 and magnetic roller 46 are mounted in chamber 76 of housing 44. The donor roller can be rotated in either the 'with' or 'against' direction relative to the direction of motion of belt 10. In FIG. 1, donor roll 40 is shown rotating in the direction of arrow 68, i.e., the against direction. Similarly, the magnetic roller can be configured to rotate in either the 'with' or 'against' direction relative to the direction of motion of donor roll 40. In FIG. 1, magnetic roller 46 is shown rotating in the direction of arrow 92 i.e. the against direction. Donor roll 40 is preferably in the form of a conductive core with a plasma-sprayed ceramic coating.

Development system 38 also has electrode wires 42 which are disposed in the space between the belt 10 and donor roll 40. A pair of electrode wires are shown extending in a direction substantially parallel to the longitudinal axis of the donor roll. The electrode wires are made from of one or more thin (e.g. 50 to 100 $\mu$ diameter) stainless steel wires which are closely spaced from donor roll 40. When the development system is operating, the distance between the wires and the donor roll is approximately 25 $\mu$ or the thickness of the toner layer on the donor roll. The wires are self-spaced from the donor roll by the thickness of the toner on the donor roll. To this end the extremities of the wires supported by the tops of end bearing blocks also support the donor roll for rotation. The wire extremities are attached so that they are slightly below a tangent to the surface, including toner layer, of the donor structure. Mounting the wires in such a manner makes them insensitive to roll runout due to their self-spacing.

As illustrated in FIG. 1, an alternating electrical bias is applied to the electrode wires by an AC voltage source 78. In operation, the applied AC establishes an alternating electrostatic field between the wires and the donor roll which is effective in detaching charged toner from the surface of the donor roll and forming a toner cloud about the wires, the height of the cloud being such as not to be substantially in contact with the belt 10. During operation, the magnitude of the AC voltage is in the order of 200 to 900 volts peak at a frequency ranging from about 3 kHz to about 10 kHz. A DC bias supply 80 which applies approximately 300 volts to donor roller 40 establishes an electrostatic field between photoconductive surface 12 of belt 10 and donor roll 40 for attracting the detached toner particles from the cloud surrounding the wires to the latent image recorded on the photoconductive surface. At a spacing ranging from about 10 $\mu$ to about 40 $\mu$ between the electrode wires and donor roll, an applied voltage of 200 to 600 volts produces a relatively large electrostatic field without risk of air breakdown. The use of a dielectric coating on either the electrode wires or donor roll helps to prevent shorting of the applied AC voltage. Magnetic roller 46 meters a constant quantity of toner having a substantially constant charge onto donor roll 40. It is preferable that the donor roller provide a constant amount of toner having a substantially constant charge in the development gap. The combination of donor roller spacing, i.e., spacing between the donor roll 40 and the magnetic roller 46, the compressed pile height of the developer material on the magnetic roller, and the magnetic properties of the magnetic roller in conjunction with the use of a conductive, magnetic developer material achieves the deposition of a constant quantity of toner having a substantially constant charge on the donor roller. During operation, DC bias supply 84 applies approximately 100 volts to magnetic roller 46 relative to donor roll 40 to establish an electrostatic field between magnetic roller 46 and donor roll 40 which causes toner particles to be attracted from the magnetic roller to the donor roll. Metering blade 86 is positioned closely adjacent to magnetic roller 46 to maintain the compressed pile height of the developer material on magnetic roller 46 at the desired level. Magnetic roller 46 includes a non-magnetic tubular member 88 made preferably from aluminum and having the exterior circumferential surface thereof roughened. An elongated magnet 90 is positioned interiorly of and spaced from the tubular member. The magnet is mounted stationarily. The tubular member rotates in the direction of arrow 92 to advance the developer material adhering thereto into the nip defined by donor roller 40 and magnetic roller 46. Toner particles are attracted from the carrier granules on the magnetic roller to the donor roll.

With continued reference to FIG. 1, augers, indicated generally by the reference numeral 94, are located in chamber 76 of housing 44. Augers 94 are mounted rotatably in chamber 76 to mix and transport developer material. The augers have blades extending spirally outwardly from a shaft. The blades are designed to advance the developer material in the axial direction substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive. By way of example, the carrier granules include a ferromagnetic core overcoated with a non-continuous layer of resinous material. The toner particles are made from a resinous material, such as a vinyl polymer, mixed with a coloring material, such as chromogen black. The developer material comprise from about 95% to about 99% by weight of carrier and from 5% to about 1% by weight of toner. However, one skilled in the art will recognize that any suitable developer material having at least carrier granules and toner particles may be used.

Electrode wires 42 may be physically vibrated in order to remove contaminants therefrom, by applying an AC bias having a suitable frequency thereon. During cleaning, AC voltage source 78 applies an AC electrical bias on electrode wires 42 ranging from about 1 HZ to about 100 Hz. Preferably, the electrical biasing frequency is about 10 HZ. This frequency will cause electrode wires 42 to physically oscillate allowing fibers, beads or other agglomerates trapped by wires 42 to be released and carried away by the rotating donor roll. Alternatively, AC voltage source 78 can apply a nominal AC electrical bias selected from the frequency range of between from about 3,000 HZ to about 10,000 HZ with this frequency being modulated on and off at a frequency selected from between about 1 HZ and 100 HZ with the preferred modulating frequency being 10 HZ. In either case, contaminants trapped by the electrode wires are released and removed therefrom by the rotating donor roller.

Formed as part of housing 44 is a frame, shown as two members each marked 100 in the elevational view of FIG. 1. According to the present invention, frame 100 is in the form of barriers disposed relatively close to the donor roll 40, forming relatively narrow gaps on either side thereof, in the vicinity of the electrode wires 42. Also defined in housing 44 are external air manifolds, each shown as 102, each extending from a zone near the surface of donor roll 40 and generally away from the development zone near electrode wires 42. Operatively connected to the external air manifolds 102 are one or more vacuum pumps 104, which may be dedicated specifically for the purpose of the present invention or may be those used for other suction purposes within the electrophotographic printing apparatus.

The purpose of frame 100, manifolds 102, and vacuum pumps 104 is to create a flow of air in the direction marked by arrows 106. It is known that when a belt such as photoreceptor belt 10 is caused to move through a machine at a significant velocity, there will be created on the outer surface of the moving belt 10 a "boundary layer" of air which is reasonably stationary relative to the surface of the belt 10, and which moves with the surface of the belt relative to the machine as a whole. The principal air flows 106 are from the exterior of the developer housing on either side, along the moving photoreceptor belt 10, generally around the electrode wires 42, around a portion of the outer surface of the donor roll 40, and through channels 102. (However, it should be noted that the air flow 106 is not dependent on the motion of the photoreceptor belt 10, and will be apparent regardless of the speed of photoreceptor belt 10.) This flow of air from the outside of the developer housing 44 through channels 102 to the vacuum pumps 104 will function to keep contaminants, such as lint, dirt, and toner agglomerates, from either attaching to the photoreceptor 10, causing quality defects, or spreading through other mechanisms in the machine.

Because a portion of the air flow 106 is over the surface of the donor roll 40 itself, contaminants and agglomerates may be removed directly from the toner supply on the donor roll 40. Even in the presence of a significant air flow past the surface of the donor roll 40, there is a stagnant boundary layer of air around the surface of donor roll 40 which protects the smaller toner particles but which allows the contaminants and debris particles to be removed from the surface of the donor roll 40. Thus, the present invention may serve to purify the toner even as the toner is used. The velocity of the air flow along the direction of arrows 106 may be set by the characteristics of the vacuum pumps 104, or by the width of the gap between the frame 100 and adjacent surfaces. A preferred width of the gap between the frame 100 and photoreceptor belt 10 is 1–2 mm; a gap of this width is effective in preventing any debris or toner particles from exiting the developer housing. The airflow device of the present invention may be used in conjunction with physical vibration of the electrode wires 42, as described above.

Figure 2:
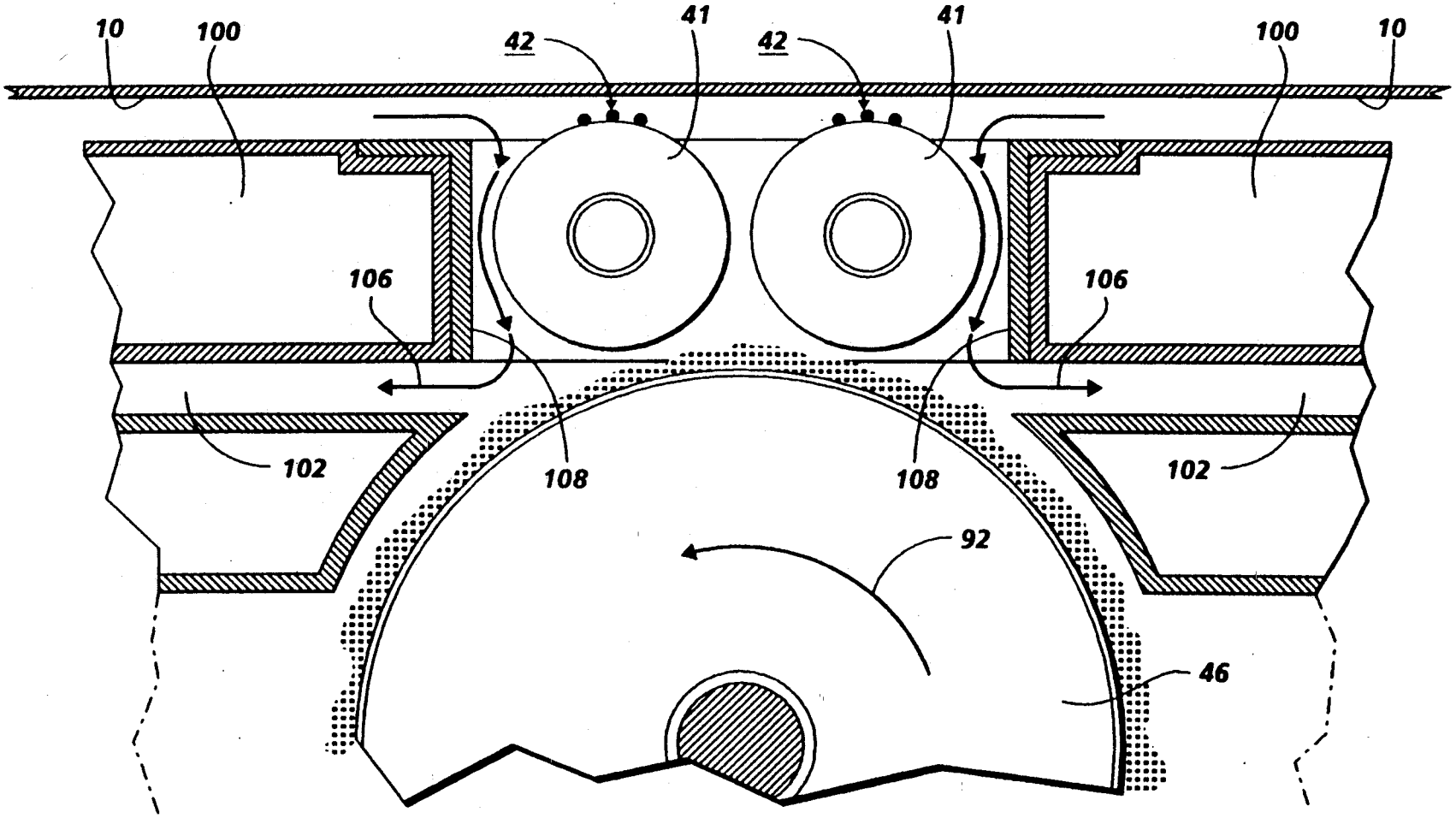
FIG. 2 is an enlarged, fragmentary, sectional, elevational view of a developer station incorporating another embodiment of the present invention.

FIG. 2 shows a preferred embodiment of the present invention, wherein the principle of the present invention is incorporated into a single dual-roll module. The detailed elevational view of FIG. 2 shows many of the same elements as the embodiment of FIG. 1, and like reference numerals indicate like elements. In the embodiment of FIG. 2, magnetic roll 46 supplies toner particles to not only one donor roll marked 40, as in FIG. 1, but to a second donor roll parallel thereto, shown as 41. As in the previous embodiment, each donor roll 40 and 41 has associated therewith a set of electrode wires 42. In this embodiment, the frame 100 is disposed close to the outer-facing sides of the donor rolls 40 and 41, and the external air manifolds 102 open onto a gap between each donor roll 40 and 41 and the larger magnetic roll 46. The surfaces of the frame 100 immediately adjacent the outer surfaces of donor rolls 40 and 41 are shown as "sidestraps" 108. The gap between sidestraps 108 and the adjacent surfaces of the donor rolls 40 and 41 is preferably optimized for a relatively rapid flow of air (shown again by arrows 106) along the outer-facing surfaces of donor rolls 40 and 41. This rapid movement of air, caused by the narrowness of the gap, may be optimized as needed for effective removal of the most common foreseen types of contaminant which are desired to be removed, such as cloth fibers.

Generally, the advantage of providing two parallel donor rolls is an increase in developing efficiency, and also to facilitate a more compact design of the development system 38. Another advantage of having two donor rolls sharing a single frame 100 is to minimize inside surfaces within the frame for contaminants to be collected upon. A one- or two-donor roll system is also conducive to construction in the form of a "wire module," in which the donor rolls, sidestraps, and, in given cases, wires form a detachable, replaceable, modular unit, as is indicated by the interfaces 109 of the sidestraps 108 against the rest of the developer housing in FIG. 2.

The means for creating the airflow within the developer system, as described above, is not limited to use with a scavengeless system using electrode wires 42 or other electrode structure in the development apparatus. In the prior art there are any number of other development techniques, such as "AC jumping," "DC jumping," or "touchdown" development, in which an electrical bias is provided directly between the donor roll and the photoreceptor with no wires disposed in the development zone, to which the airflow means of the present invention may be applied.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A development apparatus for conveying toner to a latent image recorded on a charge retentive surface, comprising:

a donor structure spaced from the surface, for conveying toner to a development zone adjacent the surface;

an electrode structure disposed in a development zone between the donor structure and the surface; and means for creating a flow of air from the charge retentive surface generally away from the development zone over at least a portion of the donor structure, the creating means forming a flow of air over the donor structure to remove contaminants therefrom with a stagnant boundary layer of air being formed around a surface of the donor structure to prevent removal of toner therefrom.

2. An apparatus as in claim 1, wherein:

the donor structure comprises a donor roll; and the flow-creating means causes air to flow over at least a portion of a surface of the donor roll.

3. An apparatus as in claim 2, wherein the electrode structure comprises a plurality of wires extending in a direction substantially parallel to the charge retentive surface.

4. A development apparatus for conveying toner to a latent image recorded on a surface, comprising:

a donor roll spaced from the surface, for conveying toner to a development zone adjacent the surface, the donor roll defining a longitudinal axis and a conveying surface;

a second donor roll spaced from the first mentioned donor roll, defining a conveying surface and having a longitudinal axis substantially parallel to the longitudinal axis of the first mentioned donor roll and the surface;

an electrode structure disposed in a development zone between at least one donor roll and the surface, the electrode structure comprising a plurality of wires extending in a direction substantially parallel to the surface; and means for creating a flow of air from the surface generally away from the development zone over at least a portion of the donor rolls, the creating means forming a flow of air over the donor structure to remove contaminants therefrom with a stagnant boundary layer of air being formed around the conveying surfaces of the donor rolls to prevent removal of toner therefrom.

5. An apparatus as in claim 4, wherein the flow-creating means causes air to flow over at least a portion of the conveying surfaces of the first mentioned donor roll and the second donor roll.

6. An apparatus as in claim 5, further comprising a frame having the first mentioned donor roll and the second donor roll mounted therein, the frame including a first sidestrap disposed adjacent a portion of the first mentioned donor roll and a second sidestrap disposed adjacent a portion of the second donor roll, with the flow-creating means causing air to flow between the first mentioned donor roll and the first sidestrap, and between the second donor roll and the second sidestrap.

7. An apparatus as in claim 6, further comprising a developer housing adapted to retain a supply of toner, and wherein the electrode structure and at least a portion of the frame including the sidestraps form a unit separable from the developer housing.

8. An apparatus as in claim 1, further comprising:

a developer housing, substantially enveloping the donor structure; and at least one manifold in the developer housing, the manifold defining a passageway from the development zone around the electrode structure.

9. An apparatus as in claim 8, wherein the flow creating means is operatively connected to the passageway for producing a flow of air through the passageway.

10. An apparatus as in claim 9, wherein the developer housing defines a chamber storing a supply of toner therein.

11. An apparatus as in claim 9, wherein the developer housing defines a gap between an edge of the developer housing and the surface with the flow creating means being adapted to produce a flow of air through the gap.

12. An apparatus as in claim 11, wherein the gap is between about 1 mm and 2 mm in width.

13. An apparatus as in claim 11, wherein the flow creating means is adapted to produce a flow of air into the developer housing.

14. A development apparatus for conveying toner to a latent image recorded on a charge retentive surface, comprising:

a donor structure spaced from the surface, for conveying toner to a development zone adjacent the surface;

a magnetic brush roll, for conveying toner from a supply to the donor structure, the magnetic brush roll including means for forming a magnetic brush for the carrying of toner thereon; and means for creating a flow of air from the charge retentive surface generally away from the development zone over at least a portion of the donor structure, the creating means forming a flow of air over the donor structure to remove contaminants therefrom with a stagnant boundary layer of air being formed around the surface of the donor structure to prevent removal of toner therefrom.

15. An apparatus as in claim 14, further comprising an electrode structure disposed in a development zone between the donor structure and the surface.

16. An apparatus as in claim 14, wherein:

the donor structure comprises a donor roll; and the flow-creating means causes air to flow over at least a portion of a surface of the donor roll.

17. A development apparatus for conveying toner to a latent image recorded on a charge retentive surface, comprising:

an electrode structure disposed in a development zone adjacent the surface;

a donor roll spaced from the surface, for conveying toner to the development zone adjacent the surface, the donor roll defining a longitudinal axis and a conveying surface;

a second donor roll spaced from the first mentioned donor roll, having a longitudinal axis substantially parallel to the longitudinal axis of the first mentioned donor roll and the surface and defining a conveying surface;

a magnetic brush roll, for conveying toner from a supply to the donor rolls, the magnetic brush roll including means for forming a magnetic brush for the carrying of toner thereon; and means for creating a flow of air from the charge retentive surface generally away from the development zone over at least a portion of the conveying surface of at least one of the donor rolls.

18. An apparatus as in claim 17, wherein the flow-creating means causes air to flow over at least a portion of the conveying surfaces of the first mentioned donor roll and the second donor roll.

19. An apparatus as in claim 18, further comprising a frame having the first mentioned donor roll and the second donor roll mounted therein, the frame including a first sidestrap disposed adjacent a portion of the first mentioned donor roll and a second sidestrap disposed adjacent a portion of the second donor roll, with the flow-creating means causing air to flow between the first mentioned donor roll and the first sidestrap, and between the second donor roll and the second sidestrap.

20. An apparatus as in claim 19, further comprising a developer housing adapted to retain a supply of toner, and wherein at least a portion of the frame including the sidestraps forms a unit separable from the developer housing.

21. An apparatus as in claim 14, further comprising:

a developer housing, substantially enveloping the donor structure; and an electrode structure disposed in a development zone between the donor structure and the surface; and at least one manifold in the developer housing, the manifold defining a passageway from the development zone around the electrode structure.

22. An apparatus as in claim 21, wherein the flow creating means is operatively connected to the passageway for producing a flow of air through the passageway.

23. A development apparatus for conveying toner to a latent image recorded on a surface, comprising:

a developer housing adapted to retain a supply of toner;

first and second donor rolls spaced from the surface, for conveying toner, from the supply of toner to a development zone adjacent the surface, each donor roll having a conveying surface; and a frame having the first donor roll and the second donor roll mounted therein, the frame including a first sidestrap disposed adjacent a portion of the first donor roll and a second sidestrap disposed adjacent a portion of the second donor roll, at least a portion of the frame including the sidestraps forming a unit separable from the developer housing.

24. An apparatus as in claim 23, further comprising a magnetic brush roll, for conveying toner from a supply to the donor rolls, the magnetic brush roll including means for forming a magnetic brush for the carrying of toner thereon.

25. An apparatus as in claim 23, further comprising an electrode structure disposed in a development zone between the donor rolls and the surface.

26. An apparatus as in claim 23, further comprising means for creating a flow of air from the surface generally away from the development zone around at least a portion of the conveying surfaces of the donor rolls.

* * * * *